US005643851A

United States Patent [19]

Konagaya et al.

[11] Patent Number: 5,643,851

[45] Date of Patent: Jul. 1, 1997

[54] REVERSIBLE THERMOSENSITIVE RECORDING LABEL AND REVERSIBLE THERMOSENSITIVE RECORDING CARD

[75] Inventors: Yukio Konagaya, Shizuoka-ken; Takao Igawa, Numazu; Akihide Ito, Mishima; Tohru Nogiwa, Numazu; Tsutomu Kagawa, Shizuoka-ken; Nobuo Yamada, Numazu, all of Japan

[73] Assignee: Ricoh Company, Ltd., Tokyo, Japan

[21] Appl. No.: 354,013

[22] Filed: Dec. 5, 1994

Related U.S. Application Data

[63] Continuation of Ser. No. 45,240, Apr. 13, 1993, abandoned.

[30] Foreign Application Priority Data

Apr. 13, 1992 [JP] Japan ..... 4-119661
Jun. 5, 1992 [JP] Japan ..... 4-171847

[51] Int. Cl.[6] ..... B41M 5/36

[52] U.S. Cl. ..... 503/201; 503/217; 503/226

[58] Field of Search ..... 503/200, 201, 503/217, 225, 226; 428/40, 195, 913, 914, 488.4; 427/150–152

[56] References Cited

U.S. PATENT DOCUMENTS

| | | | |
|---|---|---|---|
| 4,102,835 | 7/1978 | Freeman et al. | 428/40 |
| 5,219,820 | 6/1993 | Morohoshi et al. | 503/201 |
| 5,278,128 | 1/1994 | Hotta et al. | 503/201 |

*Primary Examiner*—Pamela R. Schwartz
*Attorney, Agent, or Firm*—Oblon, Spivak, McClelland, Maier & Neustadt, P.C.

[57] ABSTRACT

A reversible thermosensitive recording label for reversibly forming images and erasing recorded images thereon is composed of a reversible thermosensitive recording member having a temperature-dependent transparency which reversibly changes depending upon the temperature thereof, an adhesive layer provided on the back side of the reversible thermosensitive recording member, and a disposable release sheet applied to the adhesive layer. A reversible thermosensitive recording card is composed of the reversible thermosensitive recording member, the adhesive layer provided on the back side of the reversible thermosensitive recording member, and a label receiving material to which the adhesive layer is applied.

16 Claims, 6 Drawing Sheets

REVERSIBLE THERMOSENSITIVE RECORDING LABEL AND REVERSIBLE THERMOSENSITIVE RECORDING CARD

This application is a Continuation of application Ser. No. 08/045,240, filed on Apr. 13, 1993, now abandoned.

BACKGROUND OF THE INVENTION

1. Field of the Invention

The present invention relates to a reversible thermosensitive recording label and a reversible thermosensitive recording card which are capable of recording and erasing images repeatedly by utilizing the properties of the transparency thereof which reversibly changes from a transparent state to an opaque state, and vice versa, depending upon the temperature thereof.

2. Discussion of Background

Recently attention has been paid to a reversible thermosensitive recording material capable of temporarily recording images thereon and erasing the same therefrom when such images become unnecessary. As representative examples of this kind of reversible thermosensitive recording material, there are conventionally known reversible thermosensitive recording materials in which an organic low-molecular-weight material such as a higher fatty acid is dispersed in a matrix resin such as vinyl chloride-vinyl acetate copolymer with a glass transition temperature (Tg) of as low as 50° C. to less than 80° C., as disclosed in Japanese Laid-Open Patent Applications 54-119377 and 55-154198.

Moreover, the following reversible thermosensitive recording methods have been proposed: a method of displaying recorded information on a reversible thermosensitive recording card provided with a colored portion on the back surface thereof as disclosed in Japanese Laid-Open Utility Model Application 2-3876; a method of displaying recorded information on a reversible thermosensitive recording material provided with a light reflection layer on the back surface thereof for improving image contrast of the displayed information as disclosed in Japanese Laid-Open Patent Application 64-14079; and a method of providing a reversible thermosensitive recording material with a thin film layer at the back surface thereof with a different refractive index from that of a recording layer thereof as disclosed in Japanese Laid-Open Patent Application 2-175280.

In addition, the formation of a reversible thermosensitive recording material comprising a protective layer has been proposed for the purpose of protecting the recording layer from thermal hysteresis. This kind of protective layer can be made of a silicone rubber or silicone resin as disclosed in Japanese Laid-Open Patent Application 63-221087, a polysiloxane graft polymer as disclosed in Japanese Laid-Open Patent Application 63-317385, or an ultraviolet-curing resin or electron radiation curing resin as disclosed in Japanese Laid-Open Patent Application 2-566.

However, the above-mentioned reversible thermosensitive recording materials have the shortcomings that they are caused to deteriorate by the repetition of image recording and erasure under the application of heat and pressure by use of heat-application means such as a thermal head.

Recently, a demand is for displaying information on a thick card made of a material such as polyvinyl chloride which is used as an IC card, an ID card or a cash card. However, it is extremely difficult to uniformly coat a coating liquid for a reversible thermosensitive recording layer on a thick card made of polyvinyl chloride because (1) the polyvinyl chloride in the card is dissolved by a solvent contained in the coating liquid for the reversible thermosensitive recording layer and (2) it is extremely difficult to uniformly coat the coating liquid for the reversible thermosensitive recording layer on a thick and rigid card by means of a coating machine.

In the case of a thick card type reversible thermosensitive recording material, there is the risk that non-printed portions are formed on the images obtained unless image formation is performed under the application of a sufficiently high pressure by a thermal head thereto. Therefore, it is necessary to increase the pressure applied by the thermal head. However, when the pressure of the thermal head is set high, scratches tend to be formed on the surface of the recording material, and when the reversible thermosensitive recording material is in the form of a label, the label is easily peeled off a label receiving material.

Furthermore, when such a reversible thermosensitive recording material comprises a printed layer on the surface thereof, excellent printing suitability can be initially obtained. However, when the above reversible thermosensitive recording material is subjected to image formation and erasure many times by use of heat-application means such as a thermal head, the printed layer is scraped off by the heat and pressure applied thereto by the thermal head or by transportation rollers in a recording apparatus.

In particular, when a reversible thermosensitive recording card comprising a recording material applied to a thick card serving as a label receiving material is used for image formation, the pressure applied to the card by a thermal head is high as mentioned previously, and a large force is applied thereto in a transportation unit of a recording apparatus, so that the printed layer is considerably scraped and the reversible thermosensitive recording label tends to be peeled off the label receiving material in the transportation unit.

Conventionally, in a label employed for recording by use of a thermal head, silicone paper is employed as a disposable release sheet for the label and a pressure-sensitive adhesive agent is employed for applying the disposable release sheet to a recording member of the label. A representative example of such a pressure-sensitive adhesive agent is an acrylic emulsion.

When this type of label sheet is employed repeatedly, which is not made for repeated use and whose adhesion to a label receiving material is designed so as to be sufficient only for a single use, there is the risk that the label is peeled off the label receiving material in the course of repeated use through a transportation unit of a recording apparatus.

In the case where the adhesive agent for the above-mentioned label is replaced by an adhesive agent which can impart sufficient durability to the label for the repeated use thereof, it is possible to prevent the peeling of the label off the label receiving material during the transportation through a recording apparatus, but other problems such as the formation of non-printed portions in the obtained images occur when the label receiving material is thick and deformed.

SUMMARY OF THE INVENTION

It is therefore a first object of the present invention to provide a reversible thermosensitive recording label free from the above-mentioned conventional shortcomings, which is capable of performing image formation and erasure repeatedly by use of heat-application means such as a thermal head with a reduced pressure, and which produces images with high contrast and excellent durability without the surface of the label being scraped even when image formation and erasure are repeated.

A second object of the present invention is to provide a reversible thermosensitive recording card which is capable of performing image formation and erasure repeatedly by use of heat-application means such as a thermal head with a reduced pressure, and which produces images with high contrast and excellent durability without the surface thereof being scraped even when image formation and erasure are repeated.

The first object of the present invention can be achieved by a reversible thermosensitive recording label for reversibly forming images and erasing recorded images thereon which comprises a reversible thermosensitive recording member having a temperature-dependent transparency which reversibly changes depending upon the temperature thereof, an adhesive layer provided on the back side of the reversible thermosensitive recording member, and a disposable release sheet applied to the adhesive layer.

It is preferable that the adhesive layer have such an adhesion that when the adhesive layer is applied to a label receiving material, the adhesion between the adhesive layer and the label receiving sheet is not less than 0.5 kgf/25 mm in terms of the average tensile load at an angle of 180° C. measured in accordance with JIS K-6854.

Because of the above-mentioned structure of the reversible thermosensitive recording label sheet according to the present invention, reversible recording and displaying properties can be imparted even to a material on which a reversible thermosensitive recording layer cannot be formed by coating, and the label attached to a label receiving material is not peeled therefrom in a transportation unit of a recording apparatus and non-printed portions are not formed on the obtained image even when the label receiving material is deformed.

The second object of the present invention can be achieved by a reversible thermosensitive recording card comprising a label which comprises the above-mentioned reversible thermosensitive recording layer, and an adhesive layer formed thereon, and a label receiving material applied to the adhesive layer.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENT

A reversible thermosensitive recording label according to the present invention comprises a reversible thermosensitive recording layer for which transparency reversibly changes depending upon the temperature thereof, an adhesive layer on the reversible thermosensitive recording layer, and a disposable release sheet applied to the adhesive layer. When the reversible thermosensitive recording layer does not have sufficient self-supporting properties for use in practice, a support may be used in such a configuration that the support is interposed between the reversible thermosensitive recording layer and the adhesive layer.

The structures of a variety of reversible thermosensitive recording labels according to the present will now be explained with reference to FIGS. 2 to 16.

Figure 2:
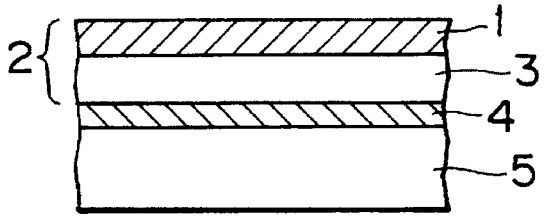
FIGS. 2 to 16 are schematic cross-sectional views of examples of a reversible thermosensitive recording label sheet of the present invention.

A label shown in FIG. 2 comprises a reversible thermosensitive recording member 2 comprising a support 3 and a reversible thermosensitive recording layer 1 formed by coating thereon; and an adhesive layer 4 formed on the back side of the support 3, opposite to the reversible thermosensitive recording layer 1 with respect to the support 3, and a disposable release sheet 5 applied to the adhesive layer 4.

When the adhesive layer 4 of the label sheet with the above-mentioned structure is applied to a label receiving material after the disposable release sheet 5 is peeled off the adhesive layer 4, a reversible thermosensitive recording card according to the present invention can be obtained.

Figure 3:
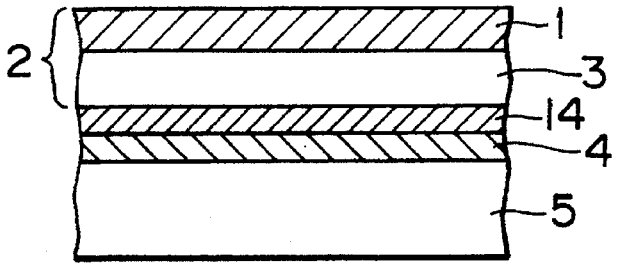

FIG. 3 shows a schematic cross-sectional view of another reversible thermosensitive recording label of the present invention comprising a printing layer 14 which is additionally interposed between the support 3 and the adhesive layer 4 in the label shown in FIG. 2.

In the reversible thermosensitive recording label according to the present invention, the adhesive layer may comprise at least two adhesive layers, and an intermediate support which is interposed between the adhesive layers. The intermediate support for use in the present invention can be made of paper or a film.

Figure 4:
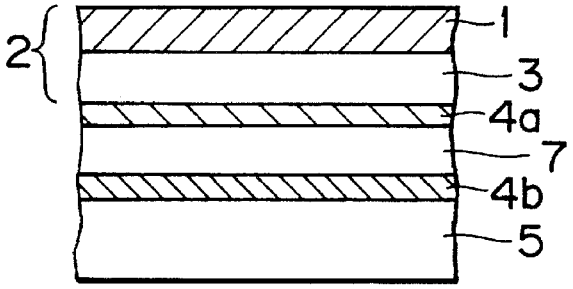

More specifically, FIG. 4 shows a schematic cross-sectional view of a reversible thermosensitive recording label sheet according to the present invention which comprises a reversible thermosensitive recording member 2 comprising a support 3 and a reversible thermosensitive recording layer 1 formed thereon, a first adhesive layer **4*a* formed on the back side of the support 3, opposite to the reversible thermosensitive recording layer 1 with respect to the support 3, an intermediate support material 7 which is made of paper or a film provided on the first adhesive layer 4*a*, a second adhesive layer 4*b* formed on the intermediate support material 7, and a disposable release sheet 5 applied to the second adhesive layer 4*b*. In a reversible thermosensitive recording label shown in FIG. 5, a printing layer 14 is interposed between the reversible thermosensitive recording member 2 and the first adhesive layer 4*a* of the reversible thermosensitive recording label shown in FIG. 4**.

Furthermore, the reversible thermosensitive recording label according to the present invention may comprise an air-containing vacant portion in the adhesive layer, through which light passes through the adhesive layer.

Figure 6:
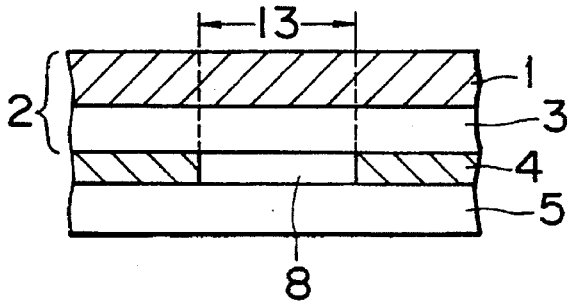

For example, as shown in FIG. 6, an air-containing vacant portion 8 can be formed in the adhesive layer 4 of a reversible thermosensitive recording label sheet with the same structure as shown in FIG. 2. In FIG. 6, the area shown by the arrows 13 serves as a display portion. With the label sheet having the above-mentioned structure, an image with improved contrast can be obtained.

When the adhesive layer for use in the reversible thermosensitive recording label comprises at least two adhesive layers and an intermediate support which is interposed between the adhesive layers, the first adhesive layer interposed between the support and the intermediate support may also comprise an air-containing vacant portion therein, through which light passes through the adhesive layer.

Figure 7:
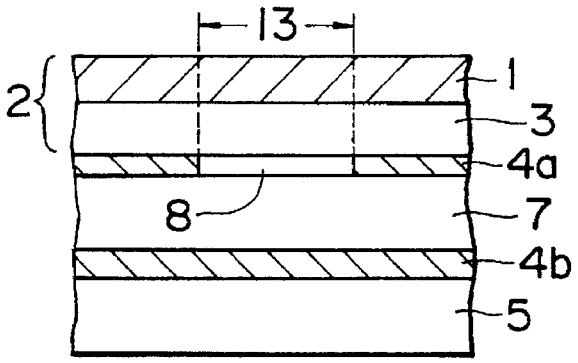

FIG. 7 shows a reversible thermosensitive recording label having the same structure as that of the reversible thermosensitive recording label shown in FIG. 4 except that an air-containing vacant portion 8 is formed in the first adhesive layer 4*a*, by which the contrast of the obtained image can be improved.

Figure 5:
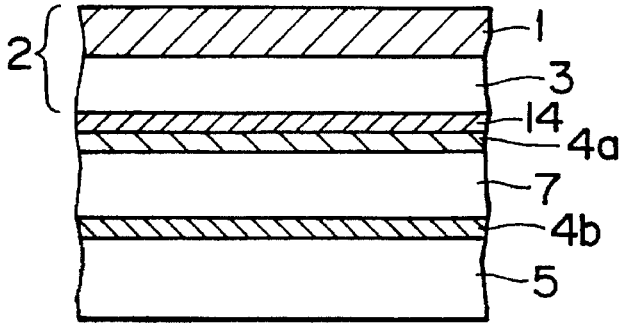
Figure 8:
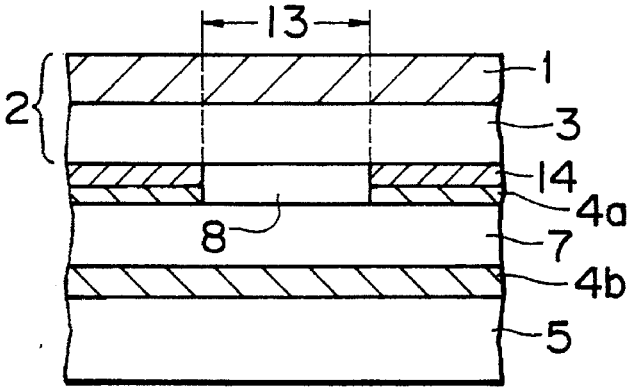

FIG. 8 shows a reversible thermosensitive recording label, having the same structure as that of the reversible thermosensitive recording label shown in FIG. 5 except that an air-containing vacant portion 8 is formed through the printing layer 14 and the first adhesive layer 4*a*.

The area indicated by the arrows 13 in each of FIGS. 7 and 8 serves as a display portion. The air-containing vacant portion 8 shown in each of FIGS. 6 to 8 does not contain any adhesive agent therein.

The reversible thermosensitive recording label of the present invention may comprise at least a reflection film layer or a coloring layer, which is disposed under the reversible thermosensitive recording layer in such a configuration that the reflection film layer or the coloring layer is visible through the reversible thermosensitive recording layer.

For instance, the reflection film layer or coloring layer may be provided between the support and the reversible thermosensitive recording layer or under the support when a transparent film is employed as the support.

Figure 9:
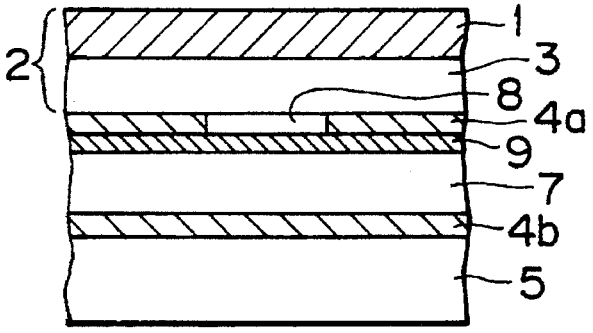

FIG. 9 shows a reversible thermosensitive recording label with the same structure as that of the reversible thermosensitive recording label as shown in FIG. 7 except that a reflection film layer or coloring layer 9 is interposed between the first adhesive layer 4*a* and the intermediate support 7.

Figure 10:
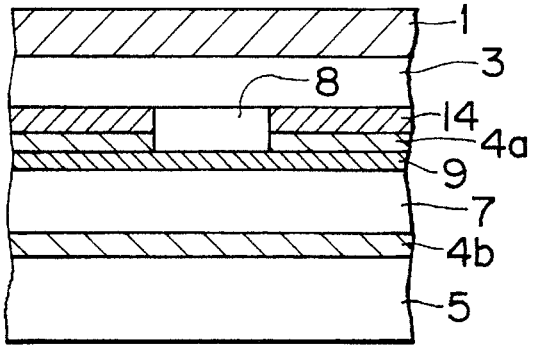

FIG. 10 shows a reversible thermosensitive recording label with the same structure as that of the reversible thermosensitive recording label as shown in FIG. 8 except that a reflection film layer or coloring layer 9 is interposed between the first adhesive layer 4*a* and the intermediate support 7.

Figure 11:
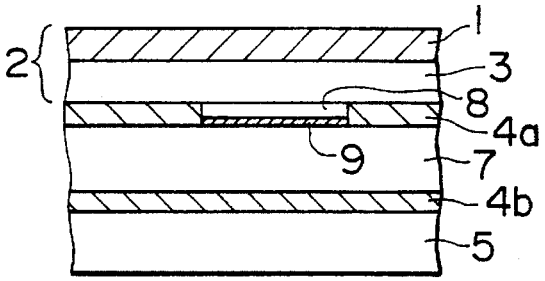

FIG. 11 shows a reversible thermosensitive recording label with the same structure as that of the reversible thermosensitive recording label as shown in FIG. 7 except that a reflection film layer or coloring layer 9 is provided at the bottom of the air-containing vacant portion in the first adhesive layer 4*a* in contact with the intermediate support 7.

Figure 12:
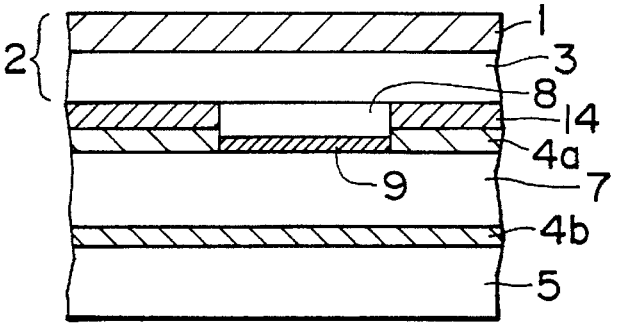

FIG. 12 shows a reversible thermosensitive recording label with the same structure as that of the reversible thermosensitive recording label as shown in FIG. 8 except that a reflection film layer or coloring layer 9 is provided at the bottom of the air-containing vacant portion 8 in the first adhesive layer 4*a* in contact with the intermediate support 7.

In the reversible thermosensitive recording labels shown in FIGS. 9 to 12, the reflection film layer or coloring layer 9 is provided at the bottom of the air-containing vacant portion 8 to further improve the image contrast.

Figure 13:
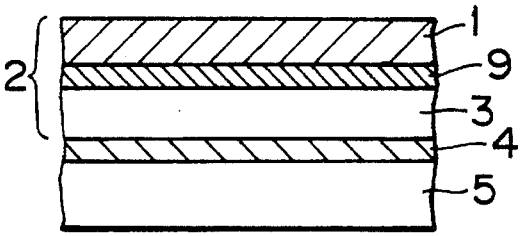

FIG. 13 shows a reversible thermosensitive recording label with the same structure as that of the reversible thermosensitive recording label as shown in FIG. 2 except that a reflection film layer or coloring layer 9 is interposed between the reversible thermosensitive recording layer 1 and the support 3.

Figure 14:
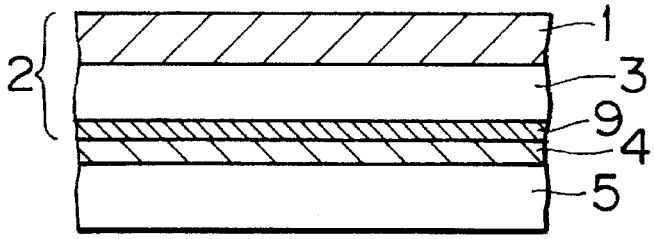

FIG. 14 shows a reversible thermosensitive recording label with the same structure as that of the reversible thermosensitive recording label as shown in FIG. 2 except that a reflection film layer or coloring layer 9 is interposed between the support 3 and the adhesive layer 4 when the support 3 is transparent.

In the reversible thermosensitive recording labels shown in FIGS. 13 and 14, the image contrast can be improved by the reflection film layer or coloring layer 9.

Figure 15:
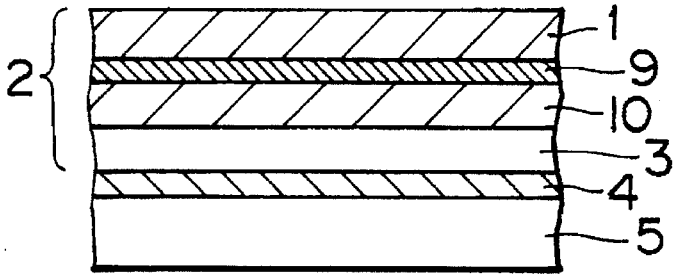

FIG. 15 shows a reversible thermosensitive recording label with the same structure as that of the reversible thermosensitive recording label as shown in FIG. 13 except that a magnetic recording layer 10 is interposed between the reflection film layer or coloring layer 9 and the support 3.

Figure 16:
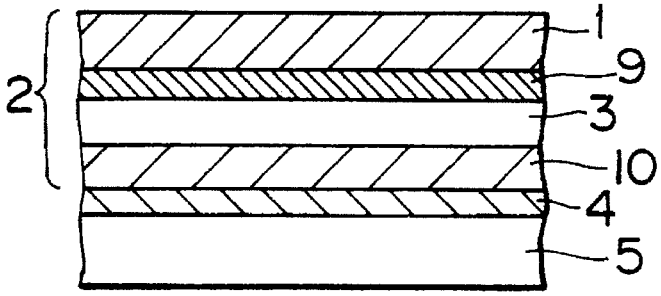

FIG. 16 shows a reversible thermosensitive recording label with the same structure as that of the reversible thermosensitive recording label as shown in FIG. 13 except that a magnetic recording layer 10 is interposed between the support 3 and the adhesive layer 4.

The magnetic recording layer 10 can be provided at any position so long as it does not affect the proper function of the reversible thermosensitive recording label.

By providing the magnetic recording layer 10 on either the front or the back side of the support 3, and the reversible thermosensitive recording layer 1 on the reflection layer or coloring layer 9 as shown in FIGS. 15 and 16, the label can be applied to a magnetic card.

A reversible thermosensitive recording card according to the present invention comprises the above-mentioned label and a label receiving material to which the label is applied.

Figure 17:
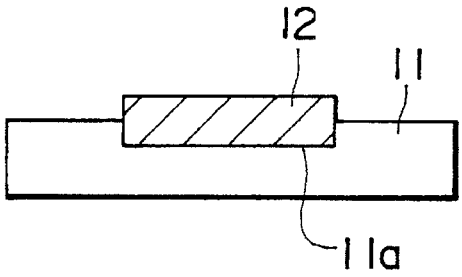
FIGS. 17 to 20 are schematic partial cross-sectional views of examples of a reversible thermosensitive recording card of the present invention.

More specifically, FIG. 17 shows a first example of a reversible thermosensitive recording card according to the present invention which comprises a reversible thermosensitive recording label 12 and a label receiving material 11.

As the reversible thermosensitive recording label 12, the above-mentioned reversible thermosensitive label can be used by removing the disposable release sheet from the adhesive layer and applying the label without the disposable release sheet to the label receiving material 11.

The label receiving material 11 has a concave embedding portion 11*a*, and the reversible thermosensitive recording label 12 is fitted into the concave embedding portion 11*a* in such a configuration that the top surface of the reversible thermosensitive recording label 12 is positioned above the surface of the label receiving material 11.

Figure 18:
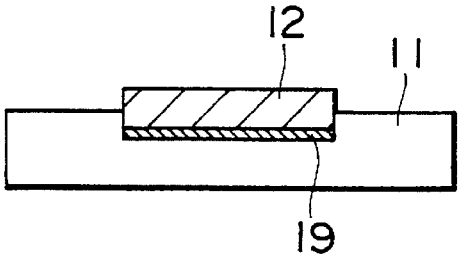

FIG. 18 shows a second example of a reversible thermosensitive recording card according to the present invention, which has the same structure as that of the reversible thermosensitive recording card as shown in FIG. 17 except that a coloring layer 19 is provided at the bottom of the concave embedding portion 11*a*.

Figure 19:
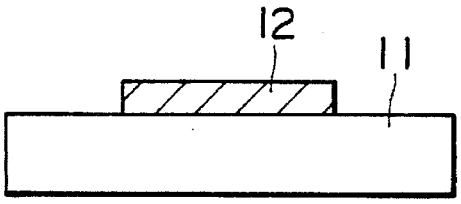

FIG. 19 shows a third example of a reversible thermosensitive recording card according to the present invention, which comprises a reversible thermosensitive recording label 12 and a label receiving material 11 to which the reversible thermosensitive recording label 12 is applied in such a configuration that the top surface of the reversible thermosensitive recording label 12 is positioned above the surface of the label receiving support 11.

Figure 20:
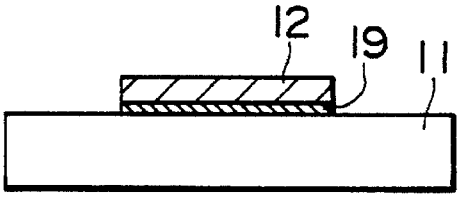

FIG. 20 shows a fourth example of a reversible thermosensitive recording card according to the present invention, which has the same structure as that of the reversible thermosensitive recording card as shown in FIG. 19 except that a coloring layer 19 is provided on part of the surface of the label receiving material 11 in such a configuration that the coloring layer 19 is interposed between the thermosensitive recording label 12 and the label receiving material 11.

Examples of the material for the support 3 for use in the present invention include plastic films such as polyethylene film, polypropylene film, polyvinyl chloride film, polyvinylidene chloride film, polyvinyl alcohol film, polyethylene terephthalate film, polycarbonate film, nylon film, polystyrene film, ethylene-vinyl acetate copolymer film, ethylene-vinyl alcohol copolymer film, polyethylene naphthalate film, fluorinated ethylene propylene film, aromatic polyamide film, polyarylate film, polyether sulfone film, polyether imide film, polyimide film, acrylic resin film, and ionomer film.

It is preferable that the support for use in the present invention have a thickness in the range of about 20 to 250 μm, more preferably in the range of 50 to 188 μm.

Moreover, a printed layer may be provided on the back side of the support, opposite to the reversible thermosensitive recording layer with respect to the support, in the reversible thermosensitive recording label sheet or card according to the present invention. In this case, it is preferable that an ultraviolet curing ink be employed as a material for the printed layer. In addition to the above, it is preferable to provide a white opacifying layer on the above-mentioned printing layer to obtain clear full-color printed images. It is preferable that the thickness of the printing layer be in the range of 2 to 10 μm.

The above-mentioned reversible thermosensitive recording label member is applied to a disposable release sheet via an adhesive layer. Alternatively, the recording label member can be overlaid on an intermediate support material made of paper or a film via a first adhesive layer, and a disposable release sheet is applied to the intermediate support via a second adhesive layer. Thus, the reversible thermosensitive recording label according to the present invention can be fabricated. In any cases, any conventional adhesive agents can be used in the adhesive layer for use in the present invention. Furthermore, it is preferable that the adhesive layer for use in the present invention comprise an adhesive agent or gluing agent with cushioning properties, which does not have any adverse influence on the reversible thermosensitive recording label member.

Specific examples of the adhesive agent or gluing agent include urea resin, melamine resin, phenolic resin, epoxy resin, vinyl acetate resin, vinyl acetate-acrylic copolymer resin, ethylene-vinyl acetate copolymer resin, acrylic resin, polyvinyl ether resin, vinyl chloride-vinyl acetate copolymer resin, polystyrene resin, polyester resin, polyurethane resin, polyamide resin, chlorinated polyolefin resin, polyvinyl butyral resin, acrylate copolymer resin, methacrylate copolymer resin, natural rubber, cyanoacrylate resin and silicone resin. A tackifier appropriate for the employed adhesive agent may be contained in the adhesive layer.

The adhesive layer may further comprise a plasticizer, a filler and an aging prevention agent, when necessary.

Of the above-mentioned adhesive agents, it is particularly preferable to employ an elastic adhesive agent comprising as the main component a synthetic rubber or a siloxane crosslinked type polymer since such an adhesive agent has a cushioning function and is effective for absorbing shocks or stress applied to the label.

An example of such an elastic adhesive agent comprising as the main components a siloxane crosslinked type polymer is composed of (i) a liquid polymer with a polyoxypropylene main chain structure, containing an amino group capable of reacting with an epoxy group, and a moisture-curing silyl group, and (ii) an epoxy resin.

As an elastic gluing agent with cushioning properties for use in the present invention, an acrylic foam gluing agent can be employed.

To prepare the adhesive layer for use in the present invention, the viscosity of the adhesive agent or gluing agent can be controlled by adding water or an organic solvent thereto, and the thus prepared adhesive agent or gluing agent is coated on the support, or on the intermediate support material by the conventional coating method. It is preferable that the thickness of the adhesive layer be in the range of about 1 to 40 μm.

When the intermediate support is overlaid on the back side of the support via an adhesive layer, paper such as plain paper or coated paper and any of the previously mentioned plastic films used as the support can be employed as the intermediate support. The material for the intermediate support may be the same as the material for the support or different from it. It is preferable that the thickness of the intermediate support be in the range of about 4 to 350 μm.

It is preferable that the reflection film layer for use in the present invention, which is provided to improve the image contrast, be prepared by the deposition of a metal. For instance, a reflection film layer comprising aluminum or zinc is preferably employed.

Furthermore, it is preferable that the coloring layer for use in the present invention have a dark color, and a black coloring layer is most preferable. The coloring layer may be provided in a concave embedding portion formed in the label receiving material for use in the present invention.

Conventionally used materials can be employed for the magnetic layer for use in the present invention.

As the disposable release sheet applied to the adhesive layer for use in the present invention, it is preferable to use a commercially available silicone paper.

When image formation and erasure are performed on the reversible thermosensitive recording label according to the present invention, the label is transported, while being held between a thermal head and a platen roller, or transported by a guide roller in a transportation unit in an image recording apparatus.

Therefore, if the adhesion strength between the label and the label sheet receiving material is not enough, there is the risk that the reversible thermosensitive recording label is peeled off the label sheet receiving material.

Therefore, in the present invention, it is preferable that the adhesion strength between the label and the label receiving sheet be not less than 0.5 kgf/25 mm in terms of the average tensile load at an angle of 180° measured in accordance with JIS K-6854.

Furthermore, when the reversible thermosensitive recording label according to the present comprises an intermediate support material which is provided on the support via an adhesive layer, it is preferable that the adhesion strength between the support and the intermediate support material be not less than 0.5 kgf/25 mm in terms of the average tensile load at an angle of 180° C. measured in accordance with JIS K-6854.

The reversible thermosensitive recording card according to the present invention can be fabricated by removing a disposable release sheet from the reversible thermosensitive recording label and applying the label without the disposable release sheet to a label sheet receiving sheet.

As the label receiving sheet, a card used as credit card made of polyvinyl chloride, IC card, ID card, paper, a film, synthetic paper, boarding pass, or a commutation ticket can be employed, although the label receiving sheet is not limited to these materials.

The reversible thermosensitive recording material employed in the reversible thermosensitive recording label and card of the present invention can be switched from a transparent state to a milky white opaque state, and vice versa, depending on the temperature thereof. The difference between the transparent state and the milky white opaque state of the recording material is considered to be based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times at the interfaces of the crystals of the low-molecular-weight material. As a result, the thermosensitive recording layer becomes opaque in a milky white color.

The transition of the state of the reversible thermosensitive recording layer depending on the temperature thereof will now be explained by referring to FIG. 1.

Figure 1:
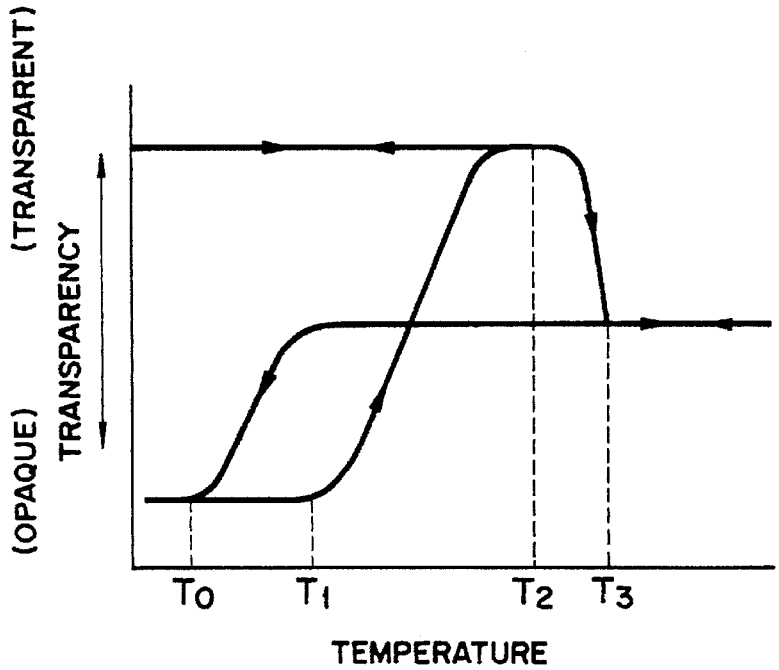
FIG. 1 is a diagram in explanation of the principle of formation and erasure of images in a reversible thermosensitive recording material for use in the present invention.

In FIG. 1, it is supposed that the reversible thermosensitive recording material comprising a matrix resin and a low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ or more is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to the room temperature $T_0$ or below, the recording material assumes an intermediate state between the transparent state and the milky white opaque state.

When the recording material in the transparent state at room temperature $T_0$ is again heated to temperature $T_3$ or above, and then cooled to room temperature $T_0$, the recording material returns to the milky white opaque state. Thus, the reversible thermosensitive recording material according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated many times.

When a colored sheet is placed behind the reversible thermosensitive recording layer of the recording material, the colored image can be obtained on the white opaque background or the white opaque image can be obtained on the colored background.

In the case where the reversible thermosensitive recording material of the present invention is projected using an OHP (Over Head Projector), a milky white opaque portion in the recording material appears dark and a transparent portion in the recording material, through which the light passes becomes a bright portion on the screen.

To record the image on the reversible thermosensitive recording material of the present invention and erase it therefrom, two thermal heads, one for image formation and the other for the image erasure, may be used.

Alternatively, a single thermal head is available if the conditions for applying the heat energy to the recording material can be changed depending on the recording operation and the erasing operation.

In the case where two thermal heads are used, a device for applying the heat energy to the recording material is expensive, however, the image formation and erasure can easily be performed by once causing the recording material to pass through the two thermal heads from which the different heat energy is separately applied to the recording material corresponding to the image formation and image erasure. On the other hand, in the case where a single thermal head is used for both image formation and erasure, the cost of the above-mentioned device is low, but the operation becomes complicated. More specifically, it is necessary to delicately change the heat application conditions of the single thermal head corresponding to a portion where an image is to be recorded or erased while the recording material is caused to pass through the single thermal head at one operation. Alternatively, the images are erased by applying the thermal energy for image erasure to the recording material while the recording material is first caused to pass through the single thermal head. Then, when the recording material is caused to reversibly pass through the single thermal head, the images are recorded by the application of the thermal energy for image formation to the recording material.

To form the reversible thermosensitive recording layer on the support, (1) a solution in which both the matrix resin and the organic low-molecular-weight material are dissolved, or (2) a dispersion prepared by dispersing the the organic low-molecular-weight material which is pulverized in a matrix resin solution may be coated on the support, and then the solvent is caused to evaporate, so that the reversible thermosensitive recording layer can be formed in the shape of a thin film or a sheet on the support. The aforementioned matrix resin dispersion of the low-molecular-weight material (2) employs a solvent in which only the matrix resin can be dissolved.

The solvent used for the formation of the thermosensitive recording layer can be selected depending on the kind of matrix resin and the type of organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. Not only when a matrix resin dispersion is used, but also when a matrix resin solution is used, the organic low-molecular-weight material separates out in the form of finely-divided particles in the matrix resin of the thermosensitive recording layer.

It is preferable that resins for use in the matrix resin of the reversible thermosensitive layer for use in the present invention have excellent film-forming properties, high transparency and high mechanical stability. Examples of such resins include polyvinyl chloride resin; vinyl chloride copolymers such as polyvinyl chloride-vinyl acetate copolymer, vinyl chloride-vinyl acetate-vinyl alcohol copolymer, vinyl chloride-vinyl acetate-maleic acid copolymer and vinyl chloride-vinyl acrylate copolymer; vinylidene chloride copolymers such as polyvinylidene chloride, vinylidene chloride-vinyl chloride copolymer, vinylidene chloride-acrylonitrile copolymer; polyester; polyamide; polyacrylate, polymethacrylate or acrylate-methacrylate copolymer; and silicone resin. These resins can be used alone or in combination.

The organic low-molecular-weight material for use in the reversible thermosensitive recording layer may be appropriately selected from the materials which are changeable from the polycrystalline state to the single crystalline state in accordance with each of the desired temperatures ranging from $T_0$ to $T_3$ as shown in FIG. 1. It is preferable that the organic low-molecular-weight material for use in the present invention have a melting point ranging from 30° to 200° C., more preferably from about 50° to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid, heneicosanoic acid, tricosanoic acid, lignoceric acid, pentacosanoic acid, cerotic acid, heptacosanoic acid, montanic acid, melissic acid, and oleic acid; esters of higher fatty acids such as methyl stearate, tetradecyl stearate, octadecyl stearate, octadecyl laurate, tetradecyl palmitate and dodecyl behenate; and the following ethers or thioethers:

$C_{16}H_{33}$—O—$C_{16}H_{33}$, $C_{16}H_{33}$—S—$C_{16}H_{33}$, $C_{18}H_{37}$—S—$C_{18}H_{37}$, $C_{12}H_{25}$—S—$C_{12}H_{25}$, $C_{19}H_{39}$—S—$C_{19}H_{39}$, $C_{12}H_{25}$—S—S—$C_{12}H_{25}$,

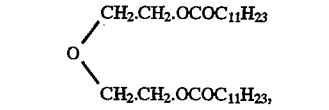

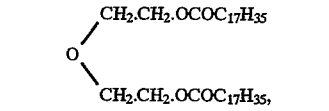

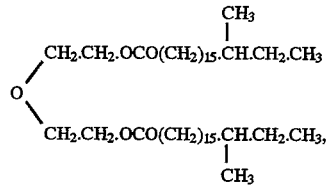

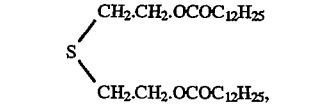

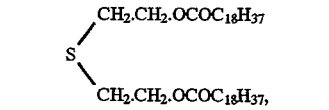

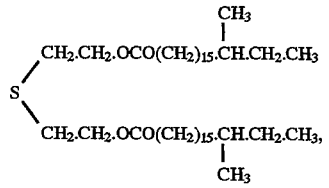

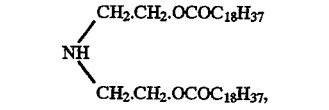

and

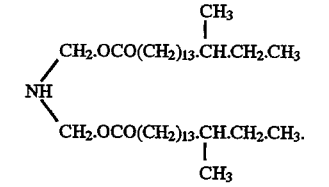

Of these, higher fatty acids having 16 or more carbon atoms, more preferably having 16 to 24 carbon atoms, such as palmitic acid, pentadecanoic acid, nonadecanoic acid, arachic acid, heneicosanoic acid, tricosanoic acid, lignoceric acid, stearic acid and behenic acid are preferred in the present invention.

Furthermore, it is possible to employ one of the previously mentioned organic low-molecular-weight materials, and another as a crystal growth controlling agent in combination. For instance, when stearic acid is employed as the organic low-molecular-weight material, stearyl alcohol can be used as a material for controlling the crystal growth.

It is preferable that the ratio by weight of the organic low-molecular-weight material to the material for controlling the crystal growth of the organic low-molecular-weight material be in the range of (1:0.1) to (1:0.8).

When the weight ratio of the organic low-molecular-weight material to the material for controlling the crystal growth of the organic low-molecular-weight material is within the above range, the temperature range or the energy range in which the reversible thermosensitive recording material can assume a transparent state is sufficiently increased, and the white opaque degree in a white opaque state is not decreased.

It is preferable that the ratio by weight of the organic low-molecular-weight material to the matrix resin be in the range of about (2:1) to (1:16), more preferably in the range of (1:2) to (1:8) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

It is preferable that the reversible thermosensitive recording layer have a thickness of 1 to 30 μm, more preferably a thickness of 2 to 20 μm, in order to make the thermal distribution of the reversible thermosensitive recording layer uniform, and to obtain a uniform transparent state and a white opaque state with high contrast. The degree of the white opaqueness can be increased by increasing the amount of the organic low-molecular-weight material in the thermosensitive recording layer.

In the reversible thermosensitive recording layer for use in the present invention, additives such as a surface-active agent and a high-boiling point solvent can be employed to facilitate the formation of a transparent image.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol di-2-ethyl butyrate, methyl acetylricinoleate, butyl acetylricinoleate, butylphthalyl butyl glycolate and tributyl acetylcitrate.

Examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate-amine-containing monomer copolymer; styrene-maleic anhydride copolymer; and olefin-maleic anhydride copolymer.

A protective layer may be formed on the reversible thermosensitive recording layer in order to prevent the thermosensitive recording layer from being deformed by the heat and pressure applied by a thermal head and from the transparency of the transparent portion thereof being decreased by such deformation. It is preferable that the protective layer have a thickness in the range of 1 μm to 15 μm, more preferably in the range of about 2 to 10 μm. By the protective layer with a thickness in the range of 1 to 15 μm, the reversible thermosensitive recording layer can be satisfactorily protected without the thermosensitivity thereof being decreased. As the material for the protective layer, silicone rubber, silicone resin, polysiloxane graft polymer, ultraviolet-curing resin and electron radiation curing resin can be employed. In any case, the material for the protective layer is dissolved in a solvent to prepare a coating liquid and the thus prepared coating liquid is coated on the thermosensitive recording layer. Thus it is desirable that the resin and the organic low-molecular-weight material for use in the thermosensitive recording layer be not easily dissolved in such a solvent for use in the protective layer.

Examples of the above-mentioned solvent in which the resin and the organic low-molecular-weight material for use in the thermosensitive recording layer are not easily dissolved include n-hexane, methyl alcohol, ethyl alcohol and isopropyl alcohol. In particular, alcohol-based solvents are preferred from the viewpoint of the cost.

Further, an intermediate layer can be interposed between the protective layer and the thermosensitive recording layer to protect the thermosensitive recording layer from the solvent or a monomer component for the protective layer formation liquid (Japanese Laid-Open Patent Application 1-133781).

Examples of the resin for use in the formation of the intermediate layer include the resins used as the matrix resin for the thermosensitive recording layer, and the following thermosetting resins and thermoplastic resins: polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness of about 0.1 μm to 2 μm to obtain an appropriate protection effect and not to reduce the thermosensitivity of the thermosensitive recording layer.

EXAMPLE 1

[Formation of Reversible Thermosensitive Recording Layer]

The following components were mixed to prepare a reversible thermosensitive recording layer coating liquid:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 20 |
| Tetrahydrofuran | 150 |
| Toluene | 15 |

The above prepared reversible thermosensitive recording layer coating liquid was coated on a polyethylene terephthalate film with a thickness of 50 μm, serving as a support, and dried under the application of heat thereto, so that a reversible thermosensitive recording layer with a thickness of about 15 μm was formed on the polyethylene terephthalate film.

[Formation of Intermediate Layer]

The following components were mixed to prepare an intermediate layer coating liquid:

| | Parts by Weight |
|---|---|
| Polyamide resin (Trademark "CM8000", made by Toray Industries Inc.) | 5 |
| Methyl alcohol | 90 |

The above prepared intermediate layer coating liquid was coated on the above-prepared reversible thermosensitive recording layer by a wire bar and dried under application of heat thereto, so that an intermediate layer with a thickness of about 0.3 μm was formed on the reversible thermosensitive recording layer.

[Formation of Protective Layer]

A butyl acetate solution of urethane-acrylate based ultraviolet-curing resin (Trademark "Unidic Ci-157" made by Dainippon Ink & Chemicals, Inc.) was coated on the above-prepared intermediate layer by a wire bar, dried under application of heat thereto, and exposed to an ultraviolet lamp of 80 W/cm for 3 seconds, so that a protective layer with a thickness of about 3 μm was formed on the intermediate layer. Thus, a reversible thermosensitive recording member A was prepared.

[Formation of Adhesive Layer]

On the back side of the support in the above prepared reversible thermosensitive recording member A, opposite to the recording layer with respect to the support, a nitrile rubber-based adhesive agent (Trademark "EC 776", made by Sumitomo 3M Ltd.) was coated, so that an adhesive layer with a thickness of about 40 μm was formed on the back side of the support.

[Formation of Release Sheet]

Thereafter, a disposable release sheet was applied to the above formed adhesive layer.

The thus prepared laminated material was stamped out into a label with a predetermined size, so that a reversible thermosensitive recording label No. 1 according to the present invention was prepared.

The label No. 1, with the elimination of the disposable release sheet therefrom, was applied to a card made of polyvinyl chloride with a thickness of 500 μm, serving as a label sheet receiving material, whereby a reversible thermosensitive recording card No. 1 according to the present invention was fabricated.

EXAMPLE 2

A nitrile rubber-based adhesive agent (Trademark "EC 776", made by Sumitomo 3M Ltd.) was coated on a polyethylene terephthalate film with a thickness of 200 μm, serving as an intermediate support, so that a first adhesive layer with a thickness of about 40 μm was formed on the intermediate support.

Subsequently, the same recording member as the reversible thermosensitive recording member A prepared in Example 1 was overlaid on the above prepared first adhesive layer in such a fashion that the back side of the support, opposite to the reversible thermosensitive recording layer, with respect to the support, came into contact with the intermediate support material via the first adhesive layer.

Thereafter, the same nitrile rubber-based adhesive agent (Trademark "EC 776" made by Sumitomo 3M Ltd.) as employed above was applied to the back side of the intermediate support material, opposite to the first adhesive layer, so that a second adhesive layer with a thickness of about 40 μm was formed on the back side of the intermediate support.

A disposable release sheet was then applied to the above prepared second adhesive layer.

The thus prepared laminated material was stamped out into a label with a label with a predetermined size, so that a reversible thermosensitive recording label No. 2 according to the present invention was prepared.

The label No. 2, with the elimination of the disposable release sheet therefrom, was applied to a card made of polyvinyl chloride with a thickness of 500 μm, serving as a label receiving material, whereby a reversible thermosensitive recoding card No. 2 according to the present invention was fabricated.

EXAMPLE 3

The procedure for preparation of the reversible thermosensitive recording label sheet No. 2 in Example 2 was repeated except that the polyethylene terephthalate film with a thickness of 200 μm, serving as the intermediate support material employed in Example 2 was replaced by a high quality paper with a thickness of 200 μm on which a black colored ink was coated or printed, serving as a coloring layer, whereby a reversible thermosensitive recording label No. 3 according to the present invention was prepared.

The thus obtained label No. 3, with the elimination of the disposable release sheet therefrom, was applied to a card made of polyvinyl chloride with a thickness of 500 μm, serving as a label receiving material, whereby a reversible thermosensitive recording card No. 3 according to the present invention was fabricated.

EXAMPLE 4

The procedure for preparation of the reversible thermosensitive recording label No. 2 in Example 2 was repeated except that an air-containing vacant portion in which no adhesive agent was contained was formed in the first adhesive layer, whereby a reversible thermosensitive recording label No. 4 according to the present invention was prepared.

The thus obtained label No. 4, with the elimination of the disposable release sheet therefrom, was applied to a card made of polyvinyl chloride with a thickness of 500 μm, serving as a label receiving material, whereby a reversible thermosensitive recording card No. 4 according to the present invention was fabricated.

EXAMPLE 5

The procedure for preparation of the reversible thermosensitive recording label sheet No. 3 in Example 3 was repeated except that an air-containing vacant portion in which no adhesive agent was contained was formed in the first adhesive layer, whereby a reversible thermosensitive recording label No. 5 according to the present invention was prepared.

The thus obtained label No. 5, with the elimination of the disposable release sheet therefrom, was applied to a card made of polyvinyl chloride with a thickness of 500 μm, serving as a label sheet receiving material, whereby a reversible thermosensitive recording card No. 5 according to the present invention was fabricated.

EXAMPLE 6

The procedure for preparation of the reversible thermosensitive recording label sheet No. 2 in Example 2 was repeated except that the polyethylene terephthalate film with a thickness of 200 μm, serving as the intermediate support material, employed in Example 2 was replaced by an aluminum-deposited polyethylene terephthalate film with a thickness of 200 μm, whereby a reversible thermosensitive recording label No. 6 according to the present invention was prepared.

The thus obtained label No. 6, with the elimination of the disposable release sheet therefrom, was applied to a card made of polyvinyl chloride with a thickness of 500 μm, serving as a label sheet receiving material, whereby a reversible thermosensitive card No. 6 according to the present invention was fabricated.

EXAMPLE 7

The procedure for preparation of the reversible thermosensitive recording label sheet No. 4 in Example 4 was repeated except that the polyethylene terephthalate film with a thickness of 200 μm, serving as the intermediate support material, employed in Example 4 was replaced by an aluminum-deposited polyethylene terephthalate film with a thickness of 200 μm, whereby a reversible thermosensitive recording label No. 7 according to the present invention was prepared.

The thus obtained label No. 7, with the elimination of the disposable release sheet therefrom, was applied to a card made of polyvinyl chloride with a thickness of 500 μm, whereby a reversible thermosensitive recording card No. 7 according to the present invention was fabricated.

EXAMPLE 8

[Formation of Magnetic Recording Layer]

A magnetic recording layer was formed on a white colored polyethylene terephthalate film with a thickness of 188 μm, serving as a support.

[Formation of Reflection Film Layer]

On the thus formed magnetic recording layer, aluminum was deposited, so that an aluminum reflection film layer was formed.

[Formation of Reversible Thermosensitive Recording Layer]

The following components were mixed to prepare a reversible thermosensitive recording layer coating liquid:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 20 |
| Tetrahydrofuran | 150 |
| Toluene | 15 |

The above prepared reversible thermosensitive recording layer coating liquid was coated on the above prepared reflection film layer, and dried under the application of heat thereto, so that a reversible thermosensitive recording layer with a thickness of about 15 μm was formed on the reflection film layer.

Thus, a reversible thermosensitive recording member B was prepared.

[Formation of Adhesive Layer]

On the back side of the support of the above prepared reversible thermosensitive recording member B, opposite to the magnetic recording layer, with respect to the support, a nitrile rubber-based adhesive agent (Trademark "EC 776", made by Sumitomo 3M Ltd.) was coated, so that an adhesive layer with a thickness of about 40 μm was formed on the back side of the support.

[Formation of Disposable Release Sheet]

Thereafter, a disposable release sheet was applied to the above formed adhesive layer.

The thus prepared laminated material was stamped out into a label with a predetermined size, so that a reversible thermosensitive recording label No. 8 according to the present invention was prepared.

The label No. 8, with the elimination of the disposable release sheet therefrom, was applied to a card made of polyvinyl chloride, whereby a reversible thermosensitive recording card No. 8 according to the present invention was fabricated.

EXAMPLE 9

The procedure for preparation of the reversible thermosensitive recording member B in Example 8 was repeated except that the reflection film layer was formed on the support and the magnetic recording layer was formed on the back side of the support, opposite to the reflection film layer with respect to the support, so that a reversible thermosensitive recording member C was prepared.

On the back side of the magnetic recording layer of the above prepared reversible thermosensitive recording member C, opposite to the reflection film layer, with respect to the support, a nitrile rubber-based adhesive agent (Trademark "EC 776", made by Sumitomo 3M Ltd.) was coated, so that an adhesive layer with a thickness of about 40 μm was formed on the back side of the magnetic recording layer.

Thereafter, a disposable release sheet was applied to the above formed adhesive layer.

The thus prepared laminated material was stamped out into a label with a predetermined size, so that a reversible thermosensitive recording label No. 9 according to the present invention was prepared.

The label No. 9, with the elimination of the disposable release sheet therefrom, was applied to a card made of polyvinyl chloride with a thickness of 500 μm, serving as a label receiving material, whereby a reversible thermosensitive recording card No. 9 according to the present invention was fabricated.

EXAMPLE 10

The procedure for preparation of the reversible thermosensitive recording label No. 1 in Example 1 was repeated except that the nitrile rubber-based adhesive agent (Trademark "EC 776", made by Sumitomo 3M Ltd.) employed for the formation of the adhesive layer in Example 1 was replaced by a silicone-based pressure-sensitive adhesive agent (Trademark "Araldite", made by Nagase CIBA Ltd.), so that a reversible thermosensitive recording label No. 10 according to the present invention was prepared.

The thus obtained label No. 10, with the elimination of the disposable release sheet therefrom, was applied to a card made of polyvinyl chloride with a thickness of 500 μm, whereby a reversible thermosensitive recording card No. 10 according to the present invention was fabricated.

The above fabricated reversible thermosensitive recording cards Nos. 1 to 10 were subjected to an image formation and erasure test by use of a recording testing apparatus equipped with a thermal head with a recording density of 8 dots/mm for such cards, with the application of an energy of 0.3 mJ for image formation, and an energy of 0.2 mJ for image erasure. This image formation and erasure cycle was repeated 100 times.

The result was that the peeling of the label away from the label receiving card did not take place in any of the above reversible thermosensitive recording cards Nos. 1 to 10 during the 100-times repetition of image formation and erasure.

The image density at the first image formation and erasure cycle, the image density at the 100th image formation and erasure cycle, and the difference therebetween were measured during the above test with respect to each of the reversible thermosensitive recording cards Nos. 1 to 10 by use of a Macbeth reflection-type densitometer. The results are shown in TABLE 1.

Furthermore, the adhesion A between the intermediate support and the thermosensitive recording member of each label and the adhesion B between each label and the label receiving material were measured in terms of average tensile load (kgf/25 mm) in accordance with the 180-degree peeling method provided in the Japanese Industrial Standards (JIS) K-6854. The results are shown in TABLE 1.

ethylene terephthalate film with a thickness of 200 μm, serving as an intermediate support material, so that a first adhesive layer with a thickness of about 40 μm was formed on the intermediate support.

A printed layer with a thickness of 5 μm comprising an ultraviolet curing ink was provided by offset printing on the back side of the support of the same recording member as the reversible thermosensitive recording member A prepared in Example 1.

The above prepared reversible thermosensitive recording member with the printed layer was overlaid on the first adhesive layer in such a fashion that the printe in layer came into contact with the intermediate support material via the above mentioned first adhesive layer.

Thereafter, on the back side of the intermediate support, opposite to the first adhesive layer, a nitrile rubber-based adhesive agent (Trademark "EC 776", made by Sumitomo 3M Ltd.) was coated, so that a second adhesive layer with a thickness of about 40 μm was formed on the intermediate support.

A disposable release sheet was applied to the second adhesive layer label to prepare a reversible thermosensitive recording material. The thus prepare reversible thermosensitive recording material was stamped out into a label with a predetermine size, whereby a reversible thermosensitive recording label No. 12 according to the present invention was prepared.

TABLE 1

| | Image Quality | | | Adhesion Strength | |
|---|---|---|---|---|---|
| | Image Density at 1st Image Formation | Image Density at 100th Image Formation | Difference in Image Density between 1st Image Formation and 100th Image Formation | A (kgf/25 mm) | B (kgf/25 mm) |
| Ex. 1 | 0.70 | 0.84 | Δ0.14 | — | 1.55 |
| Ex. 2 | 0.72 | 0.85 | Δ0.13 | 1.65 | 1.60 |
| Ex. 3 | 0.55 | 0.69 | Δ0.14 | 1.62 | 1.58 |
| Ex. 4 | 0.47 | 0.62 | Δ0.15 | 1.60 | 1.57 |
| Ex. 5 | 0.48 | 0.64 | Δ0.18 | 1.55 | 1.55 |
| Ex. 6 | 0.60 | 0.75 | Δ0.15 | 1.65 | 1.61 |
| Ex. 7 | 0.50 | 0.69 | Δ0.14 | 1.65 | 1.63 |
| Ex. 8 | 0.57 | 0.74 | Δ0.17 | 1.60 | 1.56 |
| Ex. 9 | 0.57 | 0.74 | Δ0.17 | 1.57 | 1.52 |
| Ex. 10 | 0.71 | 0.85 | Δ0.14 | 0.80 | 0.85 |

EXAMPLE 11

A printed layer with a thickness of 5 μm comprising an ultraviolet curing ink was provided by offset printing on the back side of the support of the reversible thermosensitive recording member A prepared in Example 2.

A nitrile rubber-based adhesive agent (Trademark "EC 776", made by Sumitomo 3M Ltd.) was coated on the above printed layer, so that an adhesive layer with a thickness of about 40 μm was formed thereon.

A disposable release sheet was applied to the above adhesive layer, so that a reversible thermosensitive recording material was prepared.

The thus prepared reversible thermosensitive recording material was stamped out into a label with a predetermined size, whereby a reversible thermosensitive recording label No. 11 according to the present invention was prepared.

The label No. 11, with the elimination of the disposable release sheet therefrom, was applied to a card made of polyvinyl chloride with a thickness of 500 μm, serving as a label receiving material, whereby a reversible thermosensitive recording card No. 11 according to the present invention was fabricated.

EXAMPLE 12

A nitrile rubber-based adhesive agent (Trademark "EC 776", made by Sumitomo 3M Ltd.) was coated on a polyethylene terephthalate film with a thickness of 200 μm, serving as an intermediate support material, so that a first adhesive layer with a thickness of about 40 μm was formed on the intermediate support.

The label No. 12, with the elimination of the disposable release sheet, was applied to a card made of polyvinyl chloride with a thickness of 500 μm, serving as a label receiving material, whereby a reversible thermosensitive recording card No. 12 according to the present invention was fabricated.

EXAMPLE 13

The procedure for preparation of the reversible thermosensitive recording label No. 12 in Example 12 was repeated except that an air-containing vacant portion was formed through the printed layer and the first adhesive layer, so that a reversible thermosensitive recording label No. 13 according to the present invention was prepared.

The label No. 13, with the elimination of the disposable release sheet, was applied to a card made of polyvinyl chloride with a thickness of 500 μm, serving as a label sheet receiving material, a reversible thermosensitive recording card No. 13 according to the present invention was fabricated.

EXAMPLE 14

The procedure for preparation of the reversible thermosensitive recording label No. 13 in Example 13 was repeated except that the polyethylene terephthalate film with a thickness of 200 μm serving as the intermediate support employed in Example 13 was replaced by a high quality paper with a thickness of 200 μm on which a black colored ink was coated by printing, whereby a reversible thermosensitive recording label No. 14 according to the present invention was prepared.

The label No. 14, with the elimination of the disposable release sheet, was applied to a card made of polyvinyl chloride with a thickness of 500 μm, serving as a label receiving material, whereby a reversible thermosensitive recording card No. 14 according to the present invention was fabricated.

EXAMPLE 15

The procedure for preparation of the reversible thermosensitive recording label No. 11 in Example 11 was repeated except that the nitrile rubber-based adhesive agent employed for the formation of the adhesive layer in Example 11 was replaced by a silicone-based pressure-sensitive adhesive agent (Trademark "Araldite", made by Nagase CIBA Ltd.), so that a reversible thermosensitive recording label No. 15 according to the present invention was prepared.

The label sheet No. 15, with the elimination of the disposable release sheet therefrom, was applied to a card made of polyvinyl chloride with a thickness of 500 μm, serving as a label receiving material, whereby a reversible thermosensitive recording card No. 15 according to the present invention was fabricated.

Comparative Example

The procedure for preparation of the reversible thermosensitive recording card No. 11 in Example 11 was repeated except that the printed layer employed in Example 11 was provided at the top surface of the reversible thermosensitive recording member A, not on the back side of the support, so that a comparative reversible thermosensitive recording card was prepared.

The above fabricated reversible thermosensitive recording cards Nos. 11 to 15 and the comparative reversible thermosensitive recording card were subjected to the same image formation and erasure test as with the reversible thermosensitive recording cards Nos. 1 to 10 by use of the same recording testing apparatus equipped with a thermal head with a recording density of 8 dots/mm under the same conditions.

The result was that neither the scraping of the label nor the peeling of the label away from the label receiving card took place in any of the reversible thermosensitive recording cards Nos. 11 to 15 according to the present invention during the 100-times repetition of image formation and erasure, but in the comparative reversible thermosensitive recording card, the scraping of the label took place at the 10th cycle of image formation and erasure.

The image density at the first image formation and erasure cycle, the image density at the 100th image formation and erasure cycle, and the difference therebetween were measured with respect to each of the reversible thermosensitive recording cards Nos. 11 to 15 and the comparative reversible thermosensitive recording card by use of a Macbeth reflection-type densitometer under the same conditions as with the reversible thermosensitive recording cards Nos. 1 to 10. The results are shown in TABLE 2.

Furthermore, the adhesion A between the intermediate support and the thermosensitive recording member of each label and the adhesion B between each label and the label receiving material were measured in terms of average tensile load (kgf/25 mm) in accordance with the 180-degree peeling method provided in the Japanese Industrial Standards (JIS) K-6854. The results are also shown in TABLE 2.

TABLE 2

| | Image Quality | | | Adhesion Strength | |
|---|---|---|---|---|---|
| | Image Density at 1st Image Formation | Image Density at 100th Image Formation | Difference in Image Density between 1st Image Formation and 100th Image Formation | A (kgf/25 mm) | B (kgf/25 mm) |
| Ex. 11 | 0.70 | 0.84 | Δ0.14 | — | 1.55 |
| Ex. 12 | 0.72 | 0.85 | Δ0.13 | 1.65 | 1.60 |
| Ex. 13 | 0.47 | 0.62 | Δ0.15 | 1.60 | 1.57 |
| Ex. 14 | 0.48 | 0.64 | Δ0.18 | 1.55 | 1.55 |
| Ex. 15 | 0.71 | 0.85 | Δ0.14 | 0.80 | 0.85 |
| Comp. Ex. | 0.70 | 0.84 | Δ0.14 | — | 1.55 |

EXAMPLE 16

[Formation of Reversible Thermosensitive Recording Layer]

The following components were mixed to prepare a reversible thermosensitive recording layer coating liquid:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 20 |
| Tetrahydrofuran | 150 |
| Toluene | 15 |

The above prepared reversible thermosensitive recording layer coating liquid was coated on a polyethylene terephthalate film with a thickness of 50 μm, serving as a support, and dried under the application of heat thereto, so that a reversible thermosensitive recording layer with a thickness of about 15 μm was formed on the support.

[Formation of Intermediate Layer]

The following components were mixed to prepare an intermediate layer coating liquid:

| | Parts by Weight |
|---|---|
| Polyamide resin (Trademark "CM8000", made by Toray Industries Inc.) | 5 |
| Methyl alcohol | 90 |

The above prepared intermediate layer coating liquid was coated on the above-prepared reversible thermosensitive recording layer by a wire bar and dried under the application of heat thereto, so that an intermediate layer with a thickness of about 0.3 μm was formed on the reversible thermosensitive recording layer.

[Formation of Protective Layer]

A butyl acetate solution of an urethane-acrylate based ultraviolet-curing resin (Trademark "Unidic Ci-157", made by Dainippon Ink & Chemicals, Inc.) was coated on the above-prepared intermediate layer by a wire bar, dried under the application of heat thereto, and exposed to an ultraviolet lamp of 80 W/cm for 3 seconds, so that a protective layer with a thickness of about 3 μm was formed on the intermediate layer.

Thus, a reversible thermosensitive recording member D for use in the present invention was obtained.

[Formation of Adhesive Layer]

On the back side of the support of the above prepared reversible thermosensitive recording member D, opposite to the recording layer with respect to the support, a nitrile rubber-based adhesive agent (Trademark "EC 776", made by Sumitomo 3M Ltd.) was coated, so that an adhesive layer with a thickness of about 40 μm was formed on the back side of the support.

A disposable release sheet was applied to the adhesive layer to prepare a laminated material. The thus prepared laminated material was stamped out into a label with a predetermined size, whereby a reversible thermosensitive recording label No. 16 according to the present invention was prepared.

On the other hand, a card made of polyvinyl chloride with a thickness of 500 μm was prepared as a label receiving material on which a black colored portion was provided.

The label No. 16, with the elimination of the disposable release sheet therefrom, was applied to the label receiving material in such a fashion that the label No. 16 came into contact with the black colored portion, whereby a reversible thermosensitive recording card No. 16 according to the present invention was fabricated.

The surface of the applied label No. 16 was positioned higher than that of the label receiving material in the reversible thermosensitive recording card No. 16, with a difference in level in the range of 100 to 110 μm.

EXAMPLE 17

The procedure for preparation of the reversible thermosensitive recording label No. 16 in Example 16 was repeated except that a reflection film layer was provided by depositing aluminum on the polyethylene terephthalate film with a thickness of 50 μm, serving as the support, employed in Example 16, under the reversible thermosensitive recording layer, so that a reversible thermosensitive recording label No. 17 according to the present invention was prepared.

The reversible thermosensitive recording label No. 17, with the elimination of the disposable release sheet therefrom, was applied to a card made of polyvinyl chloride with a thickness of 500 μm serving as a label receiving material, whereby a reversible thermosensitive recording card No. 17 according to the present invention was fabricated.

The surface of the applied label No. 17 was positioned higher than that of the label receiving material in the reversible thermosensitive recording card No. 17, with a difference in level in the range of 100 to 110 μm.

EXAMPLE 18

The procedure for preparation of the reversible thermosensitive recording label No. 16 in Example 16 was repeated except that an air-containing vacant portion was formed in the adhesive layer between the polyethylene terephthalate film and the disposable release sheet, so that a reversible thermosensitive recording label No. 18 according to the present invention was prepared.

As a label receiving material, a card made of polyvinyl chloride with a thickness of 500 μm with a black colored portion thereon was prepared.

The label No. 18, with the elimination of the disposable release sheet, was applied to the label receiving material in such a fashion that the label No. 18 came into contact with the black colored portion, whereby a reversible thermosensitive recording card No. 18 according to the present invention was fabricated.

The surface of the applied label No. 18 was positioned higher than that of the label receiving material in the reversible thermosensitive recording card No. 18, with a difference in level in the range of 100 to 110 μm.

EXAMPLE 19

A card made of polyvinyl chloride with a thickness of 500 μm having an embedding portion therein was prepared as a label receiving material.

The same label as the reversible thermosensitive recording label No. 17 employed in Example 17, with the elimination of the disposable release sheet therefrom, was applied to the embedding portion of the label receiving material, whereby a reversible thermosensitive recording card No. 19 according to the present invention was fabricated.

The surface of the applied label No. 19 was positioned higher than that of the label receiving material in the reversible thermosensitive recording card No. 19, with a difference in level in the range of 50 to 70 μm.

EXAMPLE 20

A card made of polyvinyl chloride with a thickness of 500 μm having an embedding portion therein was prepared as a label sheet receiving material. A black colored portion was provided at the embedding portion thereof.

The same label as the reversible thermosensitive recording label No. 18 employed in Example 18, with the elimination of the disposable release sheet therefrom, was applied to the label receiving material in such a fashion that the label No. 18 came into contact with the black colored portion in the embedding portion, whereby a reversible thermosensitive recording card No. 20 according to the present invention was fabricated.

The surface of the applied label No. 20 was positioned higher than that of the label receiving material in the reversible thermosensitive recording card No. 20 with a difference in level in the range of 50 to 70 μm.

EXAMPLE 21

The procedure for preparation of the reversible thermosensitive recording label No. 17 in Example 17 was repeated except that the nitrile rubber-based adhesive agent (Trademark "EC 776", made by Sumitomo 3M Ltd.) employed for the formation of the adhesive layer in Example 17 was replaced by an acrylic foam gluing agent (Trademark "Y-4914", made by Sumitomo 3M Ltd.), so that a reversible thermosensitive recording label No. 19 according to the present invention was prepared.

The reversible thermosensitive recording label No. 19, with the elimination of the disposable release sheet therefrom, was applied to a card made of polyvinyl chloride with a thickness of 500 μm, whereby a reversible thermosensitive recording card No. 21 according to the present invention was fabricated.

The surface of the label sheet No. 19 was positioned higher than the surface of the label sheet receiving material in the reversible thermosensitive recording card No. 21 with a difference in level of 200 μm.

EXAMPLE 22

The same label as the reversible thermosensitive recording label No. 19 obtained in Example 21, with the elimination of the disposable release sheet therefrom, was applied to the embedding portion of the same label receiving material as that employed in Example 19, whereby a reversible thermosensitive recording card No. 22 according to the present invention was fabricated.

The surface of the above label No. 19 was positioned higher than the surface of the label receiving material in the reversible thermosensitive recording card No. 22 with a difference in level of 150 μm.

EXAMPLE 23

The procedure for preparation of the reversible thermosensitive recording label No. 18 in Example 18 was repeated except that the nitrile-rubber based adhesive agent (Trademark "EC 776", made by Sumitomo 3M Ltd.) employed for the formation of the adhesive layer in Example 18 was replaced by an acrylic foam gluing agent (Trademark "Y-4914", made by Sumitomo 3M Ltd.), so that a reversible thermosensitive recording label No. 23 was prepared.

The label No. 23, with the elimination of the disposable release sheet therefrom, was applied to the same label sheet receiving material as employed in Example 20 in such a fashion that the label sheet No. 23 came into contact with the black colored portion of the label sheet receiving material, whereby a reversible thermosensitive recording card No. 23 according to the present invention was fabricated.

The surface of the above label No. 23 was positioned higher than the surface of the label sheet receiving material with a difference in level of 150 μm.

The above fabricated reversible thermosensitive recording cards Nos. 16 to 23 were subjected to the same image formation and erasure test as with the reversible thermosensitive recording cards Nos. 1 to 10 by use of the same recording testing apparatus equipped with a thermal head with a recording density of 8 dots/mm under a thermal head pressure of 1 kg/100 mm width, with the application of an energy of 0.3 mJ for image formation and with the application of an energy of 0.2 mJ for image erasure. The cycle of image formation and erasure was repeated 100 times.

The result was that neither the peeling of the label away from the label receiving card nor non-printing took place in any of the reversible thermosensitive recording cards Nos. 16 to 23 according to the present invention during the 100-times repetition of image formation and erasure.

The image density at the first image formation and erasure cycle, the image density at the 100th image formation and erasure cycle, and the difference therebetween were measured with respect to each of the reversible thermosensitive recording cards Nos. 16 to 23 by use of a Macbeth reflection-type densitometer under the same conditions as with the reversible thermosensitive recording cards Nos. 1 to 10.

Scratches formed in the recording surface of each of the reversible thermosensitive recording cards Nos. 16 to 23 and non-printed portions therein were visually inspected. The results are shown in TABLE 3.

TABLE 3

| | Image Quality | | | Scrapes Observed | |
|---|---|---|---|---|---|
| | Image Density at 1st Image Formation | Image Density at 100th Image Formation | Difference in Image Density between 1st Image Formation and 100th Image Formation | after 100-times Operation | Non-printed Image Portion |
| Ex. 16 | 0.70 | 0.83 | Δ0.13 | Δ | oΔ |
| Ex. 17 | 0.65 | 0.76 | Δ0.11 | Δ | oΔ |
| Ex. 18 | 0.66 | 0.73 | Δ0.13 | Δ | oΔ |
| Ex. 19 | 0.66 | 0.78 | Δ0.12 | Δ | oΔ |
| Ex. 20 | 0.67 | 0.72 | Δ0.15 | Δ | oΔ |
| Ex. 21 | 0.65 | 0.73 | Δ0.08 | o | o |
| Ex. 22 | 0.66 | 0.75 | Δ0.09 | o | o |
| Ex. 23 | 0.66 | 0.74 | Δ0.08 | o | o |

o — not observed
Δ — slightly observed
oΔ — little observed
x — numerously observed The results shown in TABLES 1 to 3 indicate that the reversible thermosensitive recording labels and the reversible thermosensitive recording cards according to the present invention can provide images with high quality for an extended period of time even when the image formation and erasure are repeated many times by use of heat-application means such as a thermal head.

This is because in the reversible thermosensitive recording labels and cards according to the present invention, there is used a reversible thermosensitive recording member comprising a reversible thermosensitive recording layer having a temperature-dependent transparency, an adhesive layer on the back side of the reversible thermosensitive recording layer, and a disposable release sheet on the adhesive layer, which can be removed when used.

When the reversible thermosensitive recording label sheets and cards comprise a printed layer between a support for the reversible thermosensitive recording layer and the adhesive layer, the printed layer is not scraped even when image formation and erasure are repeated many times by use of heat-application means such as a thermal head.

Since the reversible thermosensitive recording label according to the present invention, which is also used in the reversible thermosensitive recording card according to the present invention, has an adhesion strength of 0.5 kgf/25 mm or more in terms of the average tensile load at an angle of 180° measured in accordance with JIS K-6854, when applied to a label receiving material, with the elimination of the disposable release sheet therefrom, the reversible thermosensitive recording label is not peeled off the label receiving material even when image formation and erasure are repeated many times by use of heat application means such as a thermal head or the label applied to the label receiving material is transported within an image recording apparatus.

When the reversible thermosensitive recording label and card comprise two or more adhesive layers and an intermediate support material interposed therebetween, the adhesive layers have cushioning properties, so that there are no problems such as non-image formation and image erasing failure.

When the reversible thermosensitive label and card according to the present invention comprise an air-containing vacant portion in the adhesive layer, through which light pass, the contrast of an image obtained on the label or card is significantly increased.

Moreover, the reversible thermosensitive recording label and card according to the present invention can be applied to a magnetic card which comprises a magnetic recording layer. When the label comprises a reflection film layer or a coloring layer, the contrast of images can be improved.

Furthermore, when the adhesive layer of the reversible thermosensitive recording label and card according to the present invention comprises an adhesive agent or gluing agent with cushioning properties, the pressure applied by a thermal head can be so decreased that the formation of scratches in the label and the card can be prevented and therefore high-quality images can be obtained.

When the surface of the reversible thermosensitive recording layer of the label is positioned higher than that of the label receiving material in the reversible thermosensitive recording card according to the present invention, the formation of non-printed portions in the card can be prevented even when the label receiving material is deformed.

What is claimed is:

1. A reversible thermosensitive recording label for reversibly forming images and erasing recorded images thereon comprising:

a reversible thermosensitive recording member having a temperature-dependent transparency which reversibly changes depending upon the temperature thereof, an adhesive layer provided on the back side of said reversible thermosensitive recording member, and a disposable release sheet applied to said adhesive layer, wherein said adhesive layer has such an adhesion that when said adhesive layer is applied to a label receiving material, the adhesion between said adhesive layer and said label receiving material is not less than 0.5 kgf/25 mm in terms of the average tensile load at an angle of 180° measured in accordance with JIS K-6854.

2. The reversible thermosensitive recording label as claimed in claim 1, wherein said adhesive layer comprises a material having elasticity.

3. The reversible thermosensitive recording label as claimed in claims 1 or 2, further comprising a printed layer between said reversible thermosensitive recording member and said adhesive layer.

4. The reversible thermosensitive recording label as claimed in claims 1 or 2, wherein said adhesive layer comprises at least two adhesive layers, and an intermediate support material which is interposed between said adhesive layers.

5. The reversible thermosensitive recording label as claimed in claims 1 or 2, wherein said adhesive layer comprises an air-containing vacant portion therein free of adhesive agent, through which light passes.

6. The reversible thermosensitive recording label as claimed in claims 1 or 2, wherein said adhesive layer comprises an adhesive agent having cushioning properties.

7. A reversible thermosensitive recording card for reversibly forming images and erasing images thereon comprising:

a reversible thermosensitive recording member having a temperature-dependent transparency which reversibly changes depending upon the temperature thereof, an adhesive layer provided on the back side of said reversible thermosensitive recording member, and a label receiving material to which said adhesive layer is applied, wherein the adhesion between said adhesive layer and said label receiving material is not less than 0.5 kgf/25 mm in terms of the average tensile load at an angle of 180° measured in accordance with JIS K-6854.

8. The reversible thermosensitive recording card as claimed in claim 7, wherein said adhesive layer comprises a material having elasticity.

9. The reversible thermosensitive recording card as claimed in claims 7 or 8, further comprising a printed layer between said reversible thermosensitive recording member and said adhesive layer.

10. The reversible thermosensitive recording card as claimed in claims 7 or 8, wherein said adhesive layer comprises at least two adhesive layers, and an intermediate support material which is interposed between said adhesive layers.

11. The reversible thermosensitive recording card as claimed in claims 7 or 8, wherein said adhesive layer comprises an air-containing vacant portion therein free of adhesive agent, through which light passes, and which serves as a display area.

12. The reversible thermosensitive recording card as claimed in claims 7 or 8, wherein said adhesive layer comprises an adhesive agent having cushioning properties.

13. The reversible thermosensitive recording card as claimed in claims 7 or 8, further comprising a magnetic recording layer.

14. The reversible thermosensitive recording card as claimed in claims 7 or 8, further comprising a reflection layer for improving the contrast of formed images.

15. The reversible thermosensitive recording card as claimed in claims 7 or 8, further comprising a coloring layer for improving the contrast of formed images.

16. The reversible thermosensitive recording card as claimed in claims 7 or 8, wherein the surface of said reversible thermosensitive recording member is positioned higher than the surface of said label receiving material.

* * * * *

UNITED STATES PATENT AND TRADEMARK OFFICE

CERTIFICATE OF CORRECTION

PATENT NO. : 5,643,851
DATED : JULY 1, 1997
INVENTOR(S) : YUKIO KONAGAYA ET AL.

It is certified that error appears in the above-identified patent and that said Letters Patent is hereby corrected as shown below:

Column 4, line 10, "present will" should read --present invention will--.

Column 7, line 33, "In any cases," should read --In any case,--.

Column 8, line 9, "intermediate support" should read --intermediate support material--.

Column 8, line 13, "intermediate support" should read --intermediate support material--.

Column 8, line 16, "intermediate support" should read --intermediate support material--.

Column 8, line 48, "present comprises" should read --present invention comprises--.

Column 16, line 11, "recoding card" should read --recording card--.

Column 20, line 12, "printe in layer" should read --printed layer--.
line 23, "thus prepare" should read --thus prepared--.

UNITED STATES PATENT AND TRADEMARK OFFICE

CERTIFICATE OF CORRECTION

PATENT NO. : 5,643,851
DATED : JULY 1, 1997
INVENTOR(S) : YUKIO KONAGAYA ET AL.

It is certified that error appears in the above-identified patent and that said Letters Patent is hereby corrected as shown below:

Column 27, line 34, "light pass" should read --light passes--.

Signed and Sealed this

Seventh Day of July, 1998

Bruce Lehman

*Attest:*

BRUCE LEHMAN

*Attesting Officer*

*Commissioner of Patents and Trademarks*